US009960002B2

(12) United States Patent
Kohinata et al.

(10) Patent No.: US 9,960,002 B2
(45) Date of Patent: May 1, 2018

(54) ELECTROMAGNETIC RELAY

(71) Applicant: FUJITSU COMPONENT LIMITED, Tokyo (JP)

(72) Inventors: Hiroaki Kohinata, Tokyo (JP); Kazuaki Miyanaga, Tokyo (JP); Satoshi Takano, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days. days.

(21) Appl. No.: 15/414,692

(22) Filed: Jan. 25, 2017

(65) Prior Publication Data

US 2017/0221663 A1 Aug. 3, 2017

(30) Foreign Application Priority Data

Jan. 29, 2016 (JP) ..... 2016-015515

(51) Int. Cl.
*H01H 50/36* (2006.01)
*H01H 50/02* (2006.01)
*H01H 50/64* (2006.01)

(52) U.S. Cl.
CPC ..... *H01H 50/36* (2013.01); *H01H 50/026* (2013.01); *H01H 50/642* (2013.01); *H01H 2050/028* (2013.01)

(58) Field of Classification Search
CPC ..... H01H 50/24; H01H 50/04; H01H 50/36; H01H 50/56; H01H 50/46; H01H 50/641
USPC ..... 335/189
See application file for complete search history.

(56) References Cited

U.S. PATENT DOCUMENTS 6,940,375 B2 * 9/2005 Sanada ..... H01H 50/56 335/129
6,995,639 B2 * 2/2006 Minowa ..... H01H 50/443 335/78
7,157,994 B2 * 1/2007 Minowa ..... H01H 50/36 335/129
8,111,117 B2 * 2/2012 Minowa ..... H01H 50/28 335/129
2004/0113729 A1 * 6/2004 Sanada ..... H01H 50/642 335/129

(Continued)

FOREIGN PATENT DOCUMENTS

JP H09-245602 9/1997
JP H11-339623 12/1999
JP 2011-100618 5/2011

*Primary Examiner* — Shawki S Ismail
*Assistant Examiner* — Lisa Homza
(74) *Attorney, Agent, or Firm* — IPUSA, PLLC

(57) ABSTRACT

An electromagnetic relay includes an electromagnet unit, a contact unit including a movable contact spring with a movable contact provided thereon and a fixed contact spring with a fixed contact provided thereon, and a base block configured to support the electromagnet unit and the contact unit, wherein the electromagnet unit is supported at a first face of the base block, and the contact unit is supported at a second face of the base block facing in an opposite direction from the first face, and wherein the base block includes a first insulating wall extending from the first face alongside the electromagnet unit and a second insulating wall extending from the second face alongside the contact unit, the second insulating wall being situated on an opposite side from the first insulating wall across the second face.

3 Claims, 8 Drawing Sheets

(56) References Cited

U.S. PATENT DOCUMENTS

| | | | | |
|---|---|---|---|---|
| 2004/0130419 | A1* | 7/2004 | Sanada | H01H 50/023<br>335/129 |
| 2014/0203898 | A1* | 7/2014 | Li | H01H 50/641<br>335/189 |
| 2015/0116061 | A1* | 4/2015 | Fujimoto | H01H 50/36<br>335/189 |

* cited by examiner

ELECTROMAGNETIC RELAY

BACKGROUND OF THE INVENTION

1. Field of the Invention

The disclosures herein relate to an electromagnetic relay.

2. Description of the Related Art

An electromagnetic relay is known as a device that utilizes an electromagnet to control the open and closed state of contacts. The electromagnetic relay may simply be referred to as a relay. Electric current flowing through the coil of the electromagnet generates a magnetic field, based on which the iron core attracts the armature to cause the fixed contact and the movable contact to come in contact with each other. The resulting "on" state of the electromagnetic relay allows electric current to be supplied. Upon the stoppage of the current supply to the coil, the magnetic field disappears, resulting in the armature being released from the iron core due to the restoring force of a spring. As a result, the movable contact is separated from the fixed contact to cause the "off" state, thereby blocking the electric current supplied through the electromagnetic relay. In recent years, the demand has been increasing for an electromagnetic relay operable at high voltages.

For such an electromagnetic relay, size compactness is required, and so are a sufficiently strong attracting force working against the load of the spring and a sufficiently large insulating distance between the electromagnet and the contacts.

[Patent Document 1] Japanese Patent Application Publication No. 11-339623

[Patent Document 2] Japanese Patent Application Publication No. 2011-100618

[Patent Document 3] Japanese Patent Application Publication No. 9-245602

SUMMARY OF THE INVENTION

It is a general object of the present invention to provide an electromagnetic relay that substantially obviates one or more problems caused by the limitations and disadvantages of the related art.

According to an embodiment, an electromagnetic relay includes a base block, an electromagnet unit supported on a first side of the base block and including an iron core, a coil winded around the iron core, and an armature configured to be pivotably supported on the iron core, a contact unit supported on the base block and including a movable contact spring with a movable contact provided thereon and a fixed contact spring with a fixed contact provided thereon, and a first insulating wall extending from the first face alongside the electromagnet unit.

An electromagnetic relay according to at least one embodiment has small size, and also has a sufficiently strong attracting force working against the load of the spring and a sufficiently large insulating distance between the electromagnet and the contacts.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments for implementing the invention will be described. The same members or the like are referred to by the same numerals, and a description thereof will be omitted

First Embodiment

Figure 1:
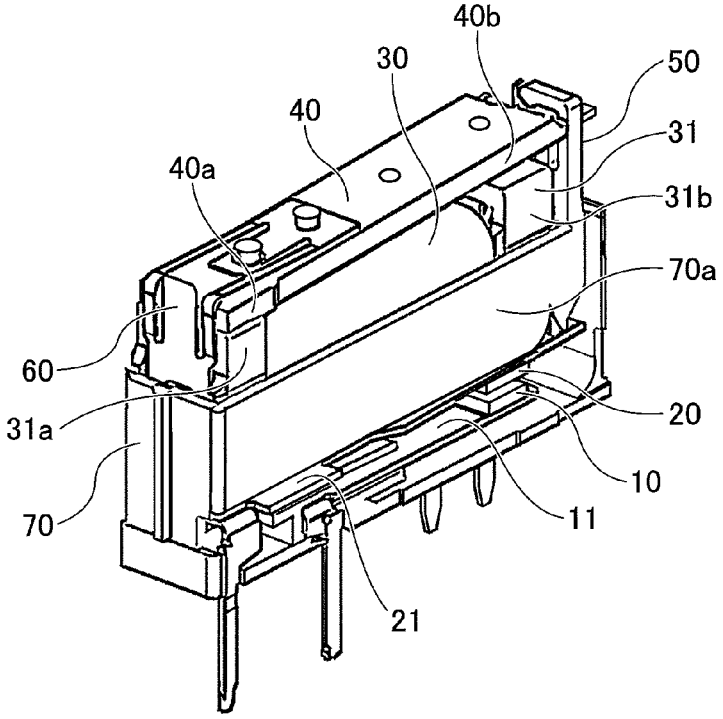
FIG. 1 is an axonometric view of an electromagnetic relay.
Figure 2:
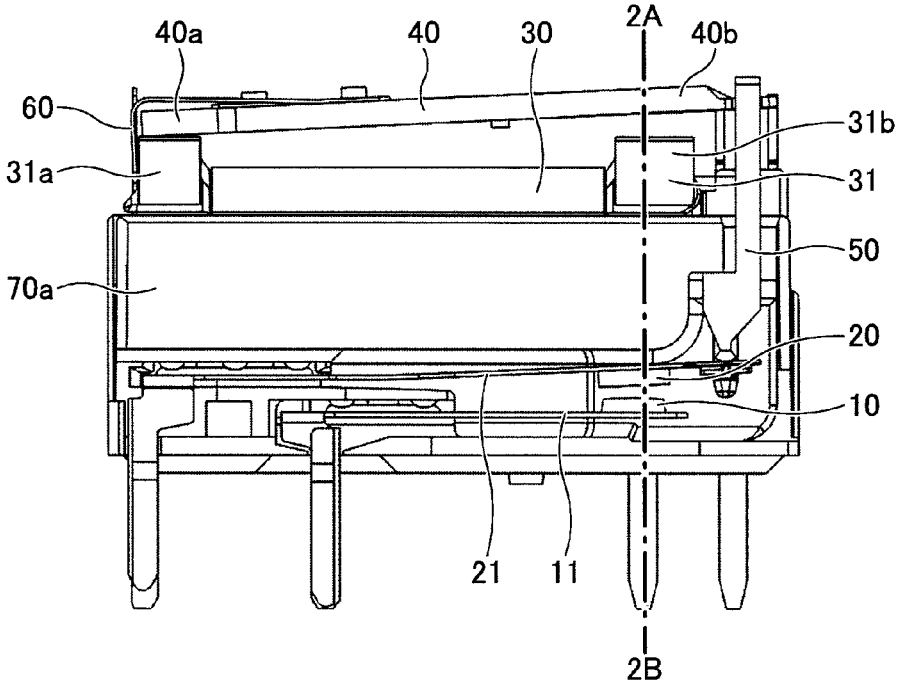
FIG. 2 is a side elevation view of the electromagnetic relay.
Figure 3A:
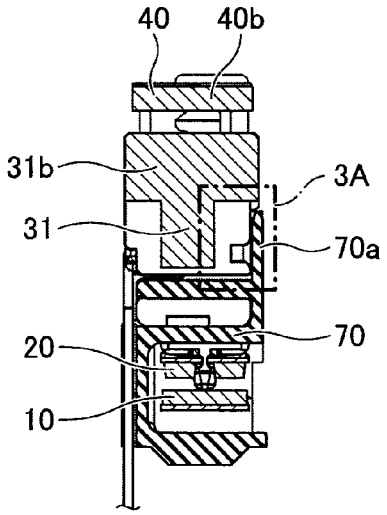
FIGS. 3A and 3B are cross-sectional views of the electromagnetic relay.
Figure 3B:
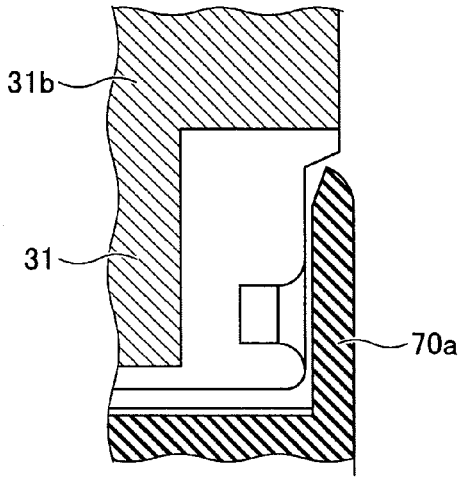
Figure 4:
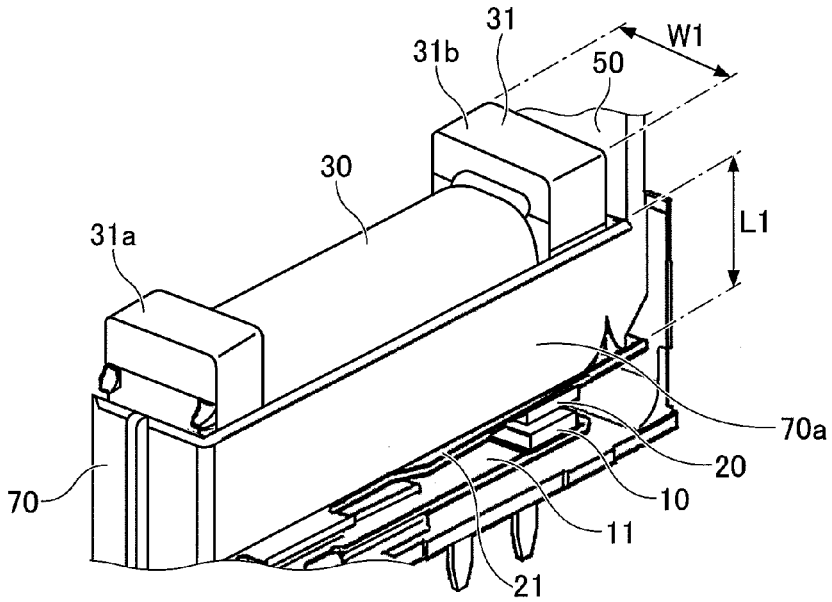
FIG. 4 is a drawing for illustrating the electromagnetic relay.

An electromagnetic relay will be described by referring to FIG. 1 through FIG. 4. FIG. 1 is an axonometric view of the electromagnetic relay. FIG. 2 is a side elevation view of the electromagnetic relay. FIG. 3A is a cross-sectional view taken along a dotted and dashed line 2A-2B in FIG. 2. FIG. 3B is an enlarged view of an area enclosed by a dotted and dashed line 3A in FIG. 3A. FIG. 4 is an axonometric view of the electromagnetic relay after removing an armature 40 and a hinge spring 60.

The electromagnetic relay illustrated in FIG. 1 through FIG. 4 includes a fixed contact 10, a movable contact 20, a coil 30, the armature 40, a card 50, the hinge spring 60, and a base block 70. The fixed contact 10 is disposed at an end of a fixed-contact spring 11. The movable contact 20 is disposed at an end of a movable-contact spring 21. The coil 30 is winded around an iron core 31. The iron core 31 has a first end 31*a* that is in contact with a first end 40*a* of the armature 40 connected to the hinge spring 60. The gap between a second end 31*b* of the iron core 31 and a second end 40*b* of the armature 40 is open when no electric current is flowing through the coil 30.

In the electromagnetic relay having such a structure, electric current flowing through the coil generates a magnetic field. The magnetic force created by the magnetic field causes the armature 40 to pivot around the contact point between its first end 40*a* and the first end 31*a* of the iron core 31 such that the second end 40*b* of the armature 40 moves toward the second end 31*b* of the iron core 31. As a result, the second end 31*b* of the iron core 31 and the second end 40*b* of the armature 40 are placed in contact with each other.

When this happens, the card 50 connected to the second end 40*b* of the armature 40 moves, so that the movable-contact spring 21 placed in contact with the tip end of the card 50 is pressed toward the fixed-contact spring 11. Consequently, the movable contact 20 comes in contact with the fixed contact 10, resulting in electric current being supplied through the movable contact 20 and the fixed contact 10.

Upon the stoppage of the supply of electric current to the coil 30, the magnetic field generated by the coil 30 disappears, and so does the magnetic force that serves to attract the second end 40*b* of the armature 40 toward the second end 31*b* of the iron core 31. As a result, the armature 40 returns to its original position due to the restoring force of the hinge spring 60. Namely, the second end 40*b* is separated from the second end 31*b*, and, in conjunction therewith, the card 50 moves to disconnect the fixed contact 10 and the movable contact 20 from each other, thereby stopping the supply of electric current.

Figure 13:
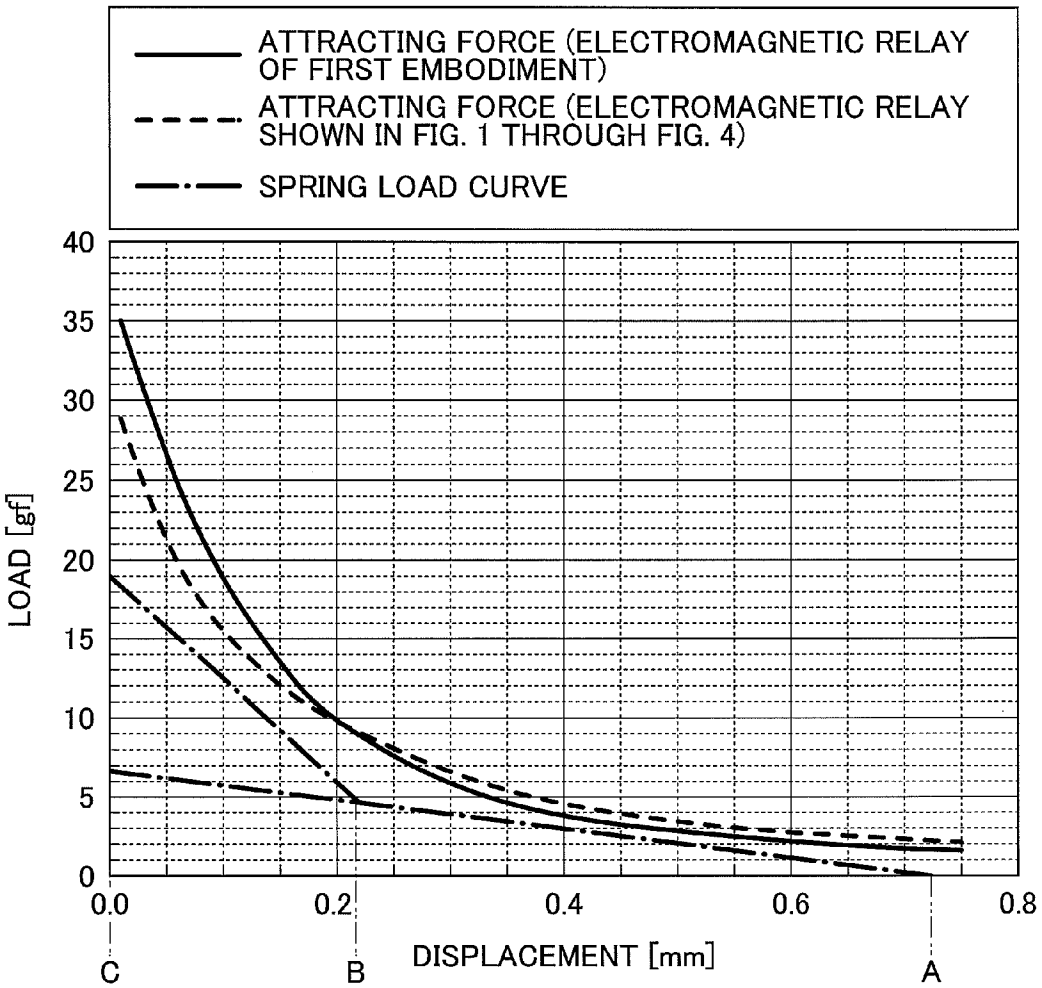
FIG. 13 is a drawing illustrating the attracting force characteristics of the electromagnetic relay.

In the following, a description will be given of the relationship between the load of the spring and the attracting force by referring to FIG. 13. In FIG. 13, the load of the spring is shown by a dotted and dashed line, and the attracting force of the electromagnetic relay illustrated in FIG. 1 through FIG. 4 is shown by a dashed line. The electromagnetic relay can operate properly if the attracting force is larger (i.e., situated higher in FIG. 13) than the load of the spring.

A displacement A indicates a point from which the movable-contact spring 21 starts moving toward the fixed-contact spring 11 upon the application of electric current to the coil 30. A displacement B indicates a point at which the movable contact 20 disposed on the movable-contact spring 21 comes in contact with the fixed contact 10 disposed on the fixed-contact spring 11. In a range from the displacement A to the displacement B, the movable-contact spring 21 moves toward the fixed-contact spring 11. A displacement C indicates a point at which the second end 31*b* of the iron core and the second end 40*b* of the armature 40 are placed in close contact with each other. In a range from the displacement B to the displacement C, the movable contact 20 is pressed further onto the fixed contact 10 by the attracting force that pulls the armature 40 toward the iron core 31 even after the movable contact 20 comes in contact with the fixed contact 10.

In the range from the displacement B to the displacement C, a sufficiently stronger attracting force than the load of the spring is needed in order to prevent contact bounce caused by the collision between the movable contact and the fixed contact during the operation of the electromagnetic relay, and is also needed in order to clean the contacts through sliding movements between the movable contact and the fixed contact.

Further, an electromagnetic relay operable at high voltage is required to have a sufficiently large distance between elements of the electromagnet such as the coil 30 or the iron core 31 and elements of a contact structure such as the movable contact 20, the fixed contact 10, the movable-contact spring 21, and the fixed-contact spring 11. This distance is referred to as an insulating distance. An insulating distance includes a spatial distance which is a distance of a space between two elements and a creepage distance which is a distance between two elements along the surface of the base block 70 and the like. In general, a creepage distance is required to be larger than a spatial distance. Therefore, the electromagnetic relay is required to have a large creepage distance along the surface of the base block 70 between the coil 30 or the iron core 31 and the elements including the movable contact 20, the fixed contact 10, the movable-contact spring 21, the fixed-contact spring 11.

In the electromagnetic relay illustrated in FIG. 1 through FIG. 4, however, the first end 31*a* and second end 31*b* of the iron core 31 project toward a first insulating wall 70*a* as illustrated in FIGS. 3A and 3B and FIG. 4. Because of this, a distance L1, which is the creepage distance on the base block 70, cannot be made large. It may be noted that a width W1 of the first end 31*a* and the second end 31*b* of the iron core 31 is 3.8 mm.

<Electromagnetic Relay>

Figure 5:
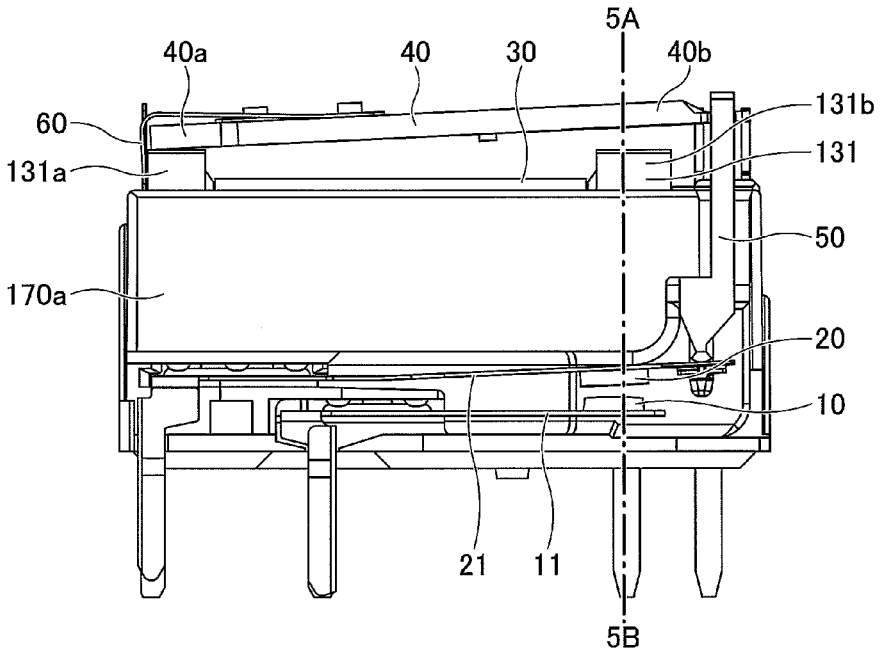
FIG. 5 is a side elevation view of the electromagnetic relay of a first embodiment.
Figure 6A:
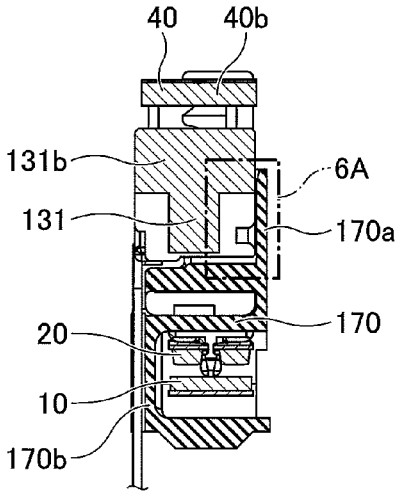
FIGS. 6A and 6B are cross-sectional views of the electromagnetic relay of the first embodiment.
Figure 6B:
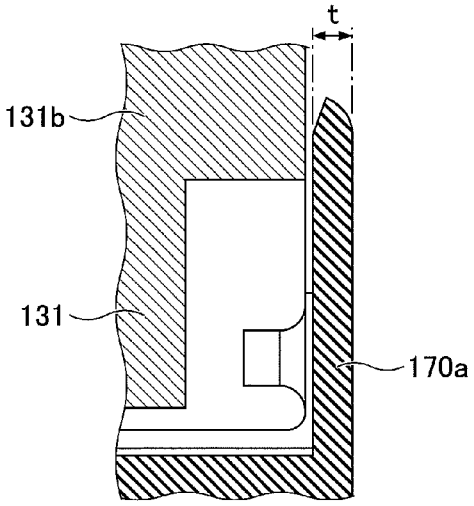
Figure 7:
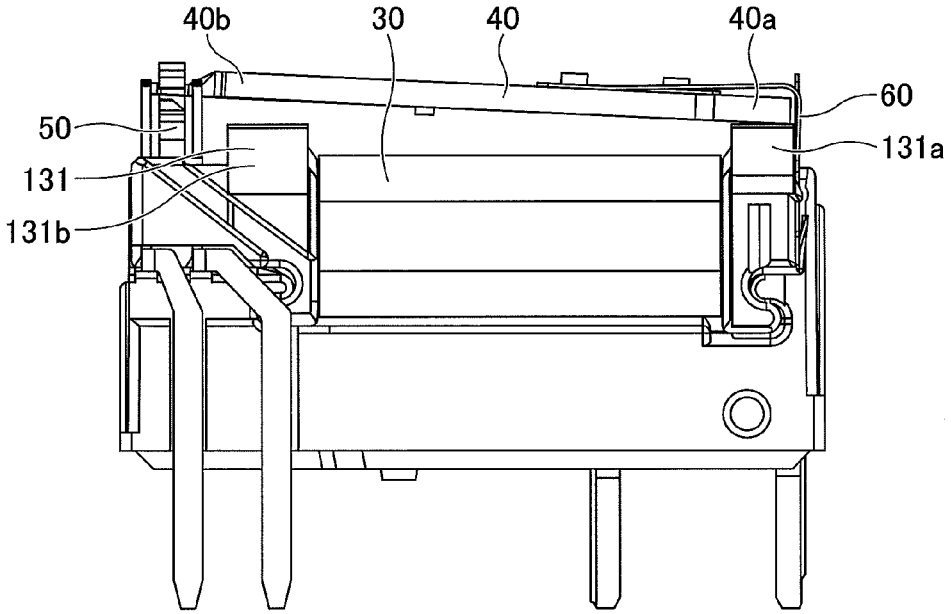
FIG. 7 is a side elevation view of the electromagnetic relay of the first embodiment.
Figure 8:
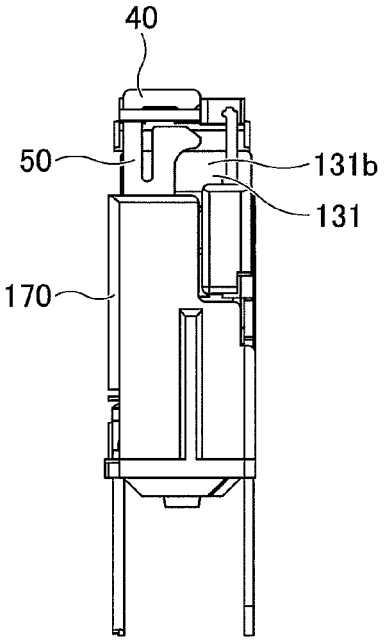
FIG. 8 is a front view of the electromagnetic relay of the first embodiment.
Figure 9:
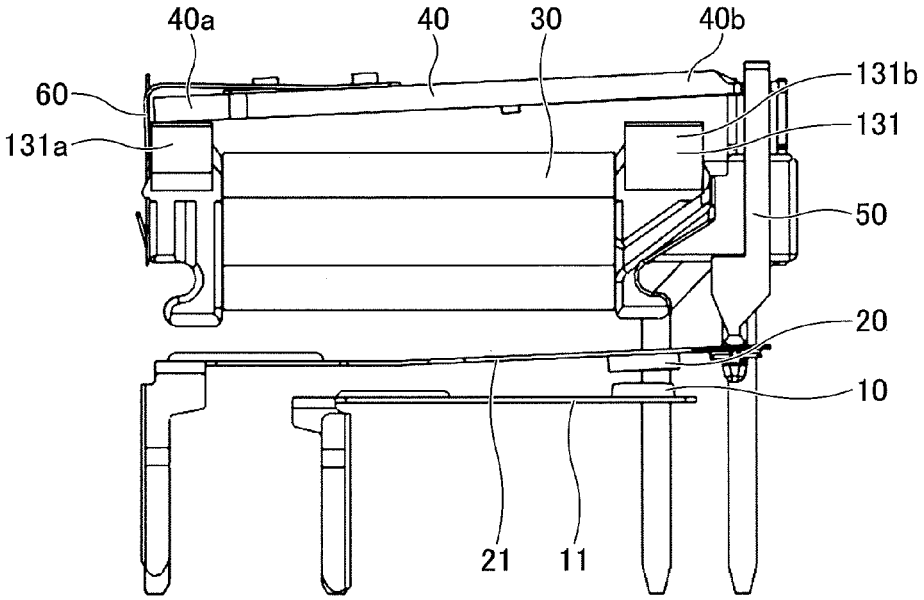
FIG. 9 is a drawing for illustrating the electromagnetic relay of the first embodiment.
Figure 10:
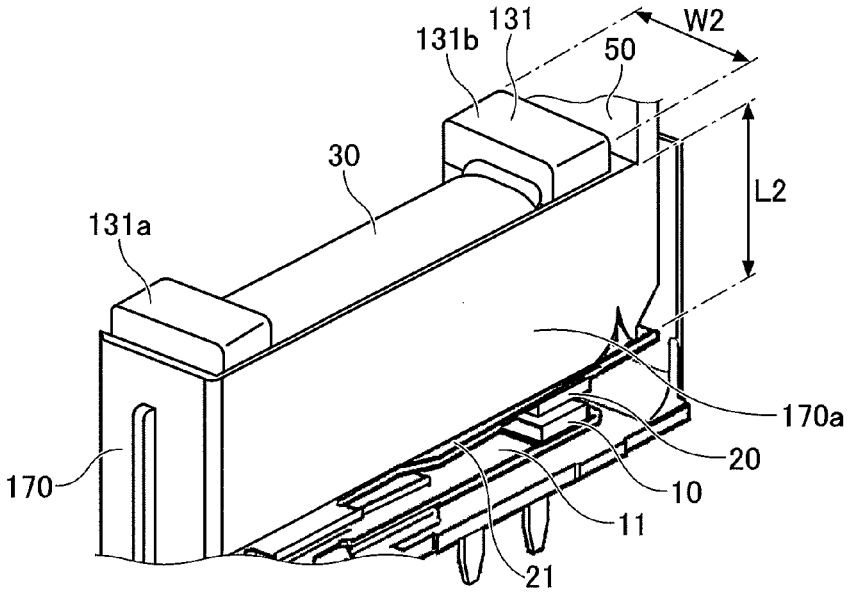
FIG. 10 is a drawing for illustrating the electromagnetic relay of the first embodiment.

In the following, the electromagnetic relay of the first embodiment will be described by referring to FIG. 5 through FIG. 10. FIG. 5 is a side elevation view of the electromagnetic relay. FIG. 6A is a cross-sectional view of the electromagnetic relay taken along the dotted and dashed line 5A-5B in FIG. 5. FIG. 6B is an enlarged view of an area enclosed by the dotted and dashed line 6A in FIG. 6A. FIG. 7 is a side elevation view of the electromagnetic relay of the opposite side from the side illustrated in FIG. 5. FIG. 8 is a front view of the electromagnetic relay. FIG. 9 is a side elevation view of the electromagnetic relay in which the base block is removed. FIG. 10 is an axonometric view of the electromagnetic relay in which the armature 40 and the hinge spring 60 are removed.

The electromagnetic relay of the present embodiment includes the fixed contact 10, the movable contact 20, the coil 30, the armature 40, the card 50, the hinge spring 60, and a base block 170. The card 50 is made of an insulating material. The base block 170 is made of an insulating material such as a resin material. The fixed contact 10 is disposed at an end of a fixed-contact spring 11. The movable contact 20 is disposed at an end of a movable-contact spring 21.

As illustrated in FIG. 6A, the base block 170 has a first insulating wall 170*a* projecting from one edge of a first face of the base block 170 substantially perpendicularly to such the first face, and a second insulating wall 170*b* projecting from the opposite edge, to the first insulating wall 170*a*, of a second face of the base block 170 substantially perpendicularly to such a face. An electromagnet unit including an iron core 131 and the armature 40 is disposed on the first face of the base block 170. A contact unit including the movable contact 20 and the fixed contact 10 is disposed on the second face of the base block 170.

Figure 11:
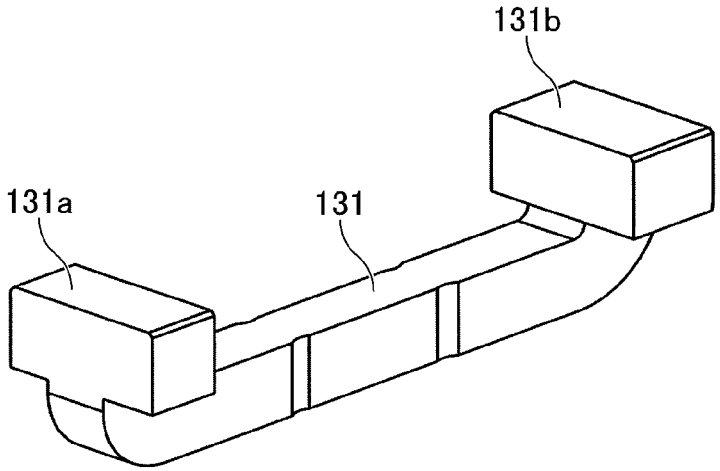
FIG. 11 is an axonometric view of an iron core of the first embodiment.
Figure 12:
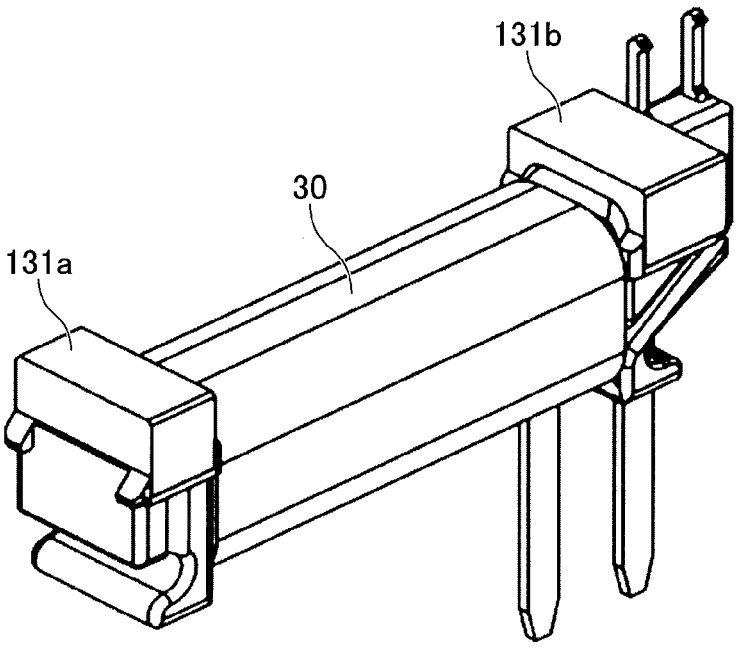
FIG. 12 is an axonometric view of the iron core and coil of the first embodiment.

As illustrated in FIG. 11, the iron core 131 has wider portions at a first end 131*a* and a second end 131*b* that are wider than the center portion of the iron core 131. As illustrated in FIG. 12, the coil 30 is formed by winding a fine metal wire around the iron core 131. The center portion of the iron core 131 is covered with the winded metal wire, with the first end 131*a* and the second end 131*b* being exposed as magnetic pole faces. The first end 131*a* is in contact with the first end 40*a* of the armature 40 connected to the hinge spring 60. A gap between the second end 131*b* and the second end 40*b* of the armature 40 is open when no electric current is flowing through the coil 30.

In the electromagnetic relay of the present embodiment, electric current flowing through the coil 30 generates a magnetic field. The magnetic force created by the magnetic field causes the armature 40 to pivot around the contact point between the armature 40 connected to the hinge spring 60 and the iron core 131 such that the second end 40*b* of the armature 40 moves toward the second end 131*b* of the iron core 131. As a result, the second end 131*b* and the second end 40*b* are placed in contact with each other. In conjunction with this, the card 50 connected to the armature 40 moves.

As a result, the movable-contact spring 21 placed in contact with the tip end of the card 50 is pressed toward the fixed-contact spring 11 so as to cause the movable contact 20 and the fixed contact 10 to come in contact with each other. Electric current is thus supplied through the fixed contact 10 and the movable contact 20.

Upon the stoppage of the supply of electric current to the coil 30, the magnetic field generated by the coil 30 disappears, and so does the magnetic force, that serves to attract the armature 40 toward the iron core 131. As a result, the armature 40 returns to its original position due to the restoring force of the hinge spring 60. Namely, the second end 40*b* is separated from the second end 131*b*, which causes the card 50 to move. The fixed contact 10 and the movable contact 20 are thus separated from each other to stop the supply of electric current.

In the electromagnetic relay of the present embodiment, each side of the first end 131*a* and second end 131*b* of the iron core 131 facing the first insulating wall 170*a* is retracted as illustrated in FIG. 6B, so that a width W2 of the first end 131*a* and the second end 131*b* is narrower than the width W1 as illustrated in FIG. 4. The width W1 of the first end 31*a* and second end 31*b* in the electromagnetic relay illustrated in FIG. 1 is 3.8 mm. In comparison, the width W2 of the present embodiment is 3.55 mm, which is 0.25 mm narrower. With this arrangement, the magnetic pole face of the second end 131*b* that faces the second end 40*b* of the armature 40 has a total area size smaller than that of the structure illustrated in FIG. 1. Further, since the sides of the first end 131*a* and second end 131*b* facing the first insulating wall 170*a* are retracted, the first insulating wall 170*a* may be formed to extend further upward as illustrated in FIG. 5, FIG. 6 or FIG. 10. Namely, the first insulating wall 170*a* may have a length L2 that is longer than the insulating wall 70*a*.

In the present embodiment, the length L2 of the first insulating wall 170*a* may be set approximately to 5.6 mm, which is 1-mm longer than the length L1 of the first insulating wall 70*a* that is 4.6 mm. With this arrangement, an area of the magnetic pole face of the present embodiment can be reduced to increase an attracting force in the range from the displacement B to the displacement C in FIG. 13. Also, the creepage distance of the base block 170 is increased. In this arrangement, the first end 131*a* and the second end 131*b* of the iron core 131 can be situated on the inner side of the first insulating wall 170*a*. It may be noted that the first insulating wall 170*a* has a thickness t of approximately 0.3 mm.

Inspection of the electromagnetic relay may involve the use of a work tool having a sharp tip. Since the coil 30 is a winding of an extremely fine metal wire, accidently sticking a work tool having a sharp tip in the coil 30 may cause a wire disconnection. In the present embodiment, an area of the coil 30 covered by the first insulating wall 170*a* can be increased as the length L2 of the first insulating wall 170*a* is increased. This serves to prevent, to an extent possible, a work tool from accidentally sticking in the coil 30, thereby suppressing the generation of a defective product and improving the production yield.

Moreover, by further increasing length L2 of the first insulating wall 170*a* upward, a gap between the armature 40 and the first insulating wall 170*a* can be decreased. This serves to prevent foreign substances from entering the gap between the armature 40 and the first insulating wall 170*a* to cause a defective operation.

The reason why the length L2 of the first insulating wall 170*a* is set to 5.6 mm is to ensure compliance with the UL61010-2-201 standard. This standard requires a creepage distance of 6 mm or longer with a voltage of 300 V, and when the electromagnetic relay being used with a maximum rated voltage of 277 V, a creepage distance of 5.54 mm or longer is needed. The present embodiment is designed to satisfy this requirement.

FIG. 13 illustrates comparisons between the electromagnetic relay of the first embodiment and the electromagnetic relay illustrated in FIG. 1 through FIG. 4. FIG. 13 illustrates the relationship between the displacement of the armature 40 and the load of the spring in the electromagnetic relays. The electromagnetic relay of the present embodiment exhibits an attracting force stronger than that of the electromagnetic relay illustrated in FIG. 1 through FIG. 4 in the range from the displacement B to the displacement C in which the displacement is smaller than approximately 0.21 mm. As is illustrated, the electromagnetic relay of the present embodiment utilizes the decreased width W2 of the first end 131*a* and second end 131*b* of the iron core 131 so as to provide an increased attracting force in the range of small displacements.

Second Embodiment

Figure 14:
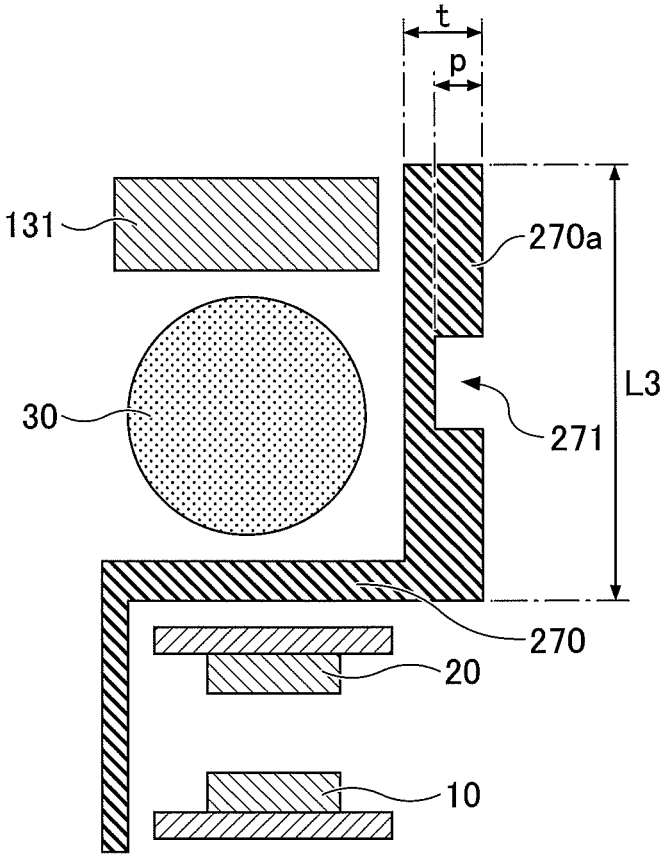
FIG. 14 is a drawing for explaining the electromagnetic relay of a second embodiment.

In the following, an electromagnetic relay according to a second embodiment will be described. The electromagnetic relay of the present embodiment has a recess in a side of the first insulating wall as illustrated in FIG. 14, thereby increasing a creepage distance despite a limited length L3 of the base block.

A creepage distance is defined as a distance along the surface of a first insulating wall 270*a*. The presence of a recess thus increases the creepage distance accordingly. The provision of a recess 271 having a depth p of 0.15 mm in the first insulating wall 270*a* serves to increase the creepage distance by 2×p, i.e., by 0.3 mm. Namely, the length L3 of the first insulating wall 270*a* may properly be set 0.3-mm shorter than the length L2 of the first insulating wall of the first embodiment. In the first embodiment, the length L2 is 5.6 mm. In the second embodiment, the provision of the recess 271 allows the length L3 to be shortened to 5.3 mm at the shortest. The first insulating wall 270*a* may have a plurality of recesses 271 formed therein.

Configurations other than those described above are the same as or similar to those of the first embodiment.

Further, although a description has been given with respect to one or more embodiments of the present invention, the contents of such a description do not limit the scope of the invention.

The present application is based on and claims the benefit of priority of Japanese priority application No. 2016-015515 filed on Jan. 29, 2016, with the Japanese Patent Office, the entire contents of which are hereby incorporated by reference.

What is claimed is:

1. An electromagnetic relay, comprising:

a base block;

an electromagnet unit supported on a first face of the base block, the electromagnetic unit including an iron core, a coil winded around the iron core, and an armature configured to be pivotably supported on the iron core; and a contact unit supported beneath a second face of the base block, the second face being opposite the first face on which the electromagnet unit is supported, the contact unit including a movable contact spring with a movable contact provided thereon and a fixed contact spring with a fixed contact provided thereon, wherein the base block includes:

a first insulating wall extending from the first face alongside the electromagnetic unit, the first insulating wall covering the coil and a side of the iron core;

a second insulating wall extending from the second face alongside the contact unit, the second insulating wall provided on an opposite side from the first insulating wall across the second face; and a third insulating wall having the first face and the second face and situated between the coil and the contact unit, the third insulating wall joining the first insulating wall and the second insulating wall.

2. The electromagnetic relay as claimed in claim 1, wherein the iron core includes a wider portion at the one end thereof, the wider portion being wider than a central portion of the iron core and serving as a magnetic pole face, and wherein at least part of the coil and the wider portion is covered with the first insulating wall.

3. The electromagnetic relay as claimed in claim 1, wherein the first insulating wall has a recess formed in a side face thereof.

* * * * *